US006236422B1

(12) United States Patent
Nagahata et al.

(10) Patent No.: US 6,236,422 B1
(45) Date of Patent: May 22, 2001

(54) THERMAL PRINTHEAD AND PROTECTIVE COVER USED FOR THE SAME

(75) Inventors: Takaya Nagahata; Yasuhiro Yoshikawa; Eiji Yokoyama, all of Kyoto (JP)

(73) Assignee: Rohm Co., Ltd., Kyoto (JP)

( * ) Notice: Subject to any disclaimer, the term of this patent is extended or adjusted under 35 U.S.C. 154(b) by 0 days.

(21) Appl. No.: 09/600,959

(22) PCT Filed: Jan. 28, 1999

(86) PCT No.: PCT/JP99/00372

§ 371 Date: Jul. 25, 2000

§ 102(e) Date: Jul. 25, 2000

(87) PCT Pub. No.: WO99/38696

PCT Pub. Date: Aug. 5, 1999

(30) Foreign Application Priority Data

Jan. 30, 1998 (JP) ..... 10-019522

(51) Int. Cl.[7] ..... B41J 2/335
(52) U.S. Cl. ..... 347/200; 347/209
(58) Field of Search ..... 347/200, 209

(56) References Cited

U.S. PATENT DOCUMENTS 5,739,837 4/1998 Nagahata et al. ..... 347/200

FOREIGN PATENT DOCUMENTS 5-162348 6/1993 (JP) ..... B41J/2/335
8-258309 10/1996 (JP) ..... B41J/2/335
9-94988 4/1997 (JP) ..... B41J/2/335
11-188906 * 7/1999 (JP) .

* cited by examiner

*Primary Examiner*—Huan Tran
(74) *Attorney, Agent, or Firm*—Michael D. Bednarek; Shaw Pittman

(57) ABSTRACT

A protective cover (9) is provided which is used for a thermal printhead including a heat sink plate (1) formed with a plurality of fixing holes (10), a head substrate (2), and a circuit board (3). The heat sink plate (1) is formed with a groove (1*a*) which divides the upper surface of the heat sink plate (1) into a first region (1*b*) and a second region (1*c*). The head substrate (2) is provided with a heating resistor (4) and drive ICs (5). The drive ICs (5) are covered with a coating resin layer (6). The circuit board (3) is formed with through-holes (11). The protective cover (9) includes a main body (9*a*) having an obverse surface and a reverse surface, and a plurality of pins (12) extending from the reverse surface. Each of the pins (12) is formed with a slit (12*a*), which facilitates press-fitting of the pin (12) into a respective one of the fixing holes (10).

16 Claims, 8 Drawing Sheets

THERMAL PRINTHEAD AND PROTECTIVE COVER USED FOR THE SAME

TECHNICAL FIELD

The present invention relates to a thermal printhead for use in a facsimile or a printer as a printing means for example. It also relates to a protective cover for protecting drive ICs and wiring patterns or the like provided on the thermal printhead.

BACKGROUND ART

A prior-art thermal printhead is disclosed for example in JP-A-8-258309. The disclosed thermal printhead includes a heat sink plate, a head substrate, and a circuit board. The head substrate and the circuit board are bonded to the heat sink plate with an adhesive. The head substrate has an upper surface on which a heating resistor and a plurality of drive ICs are mounted. The circuit board carries a connector for external connection and has an upper surface provided with a wiring pattern for connecting the drive ICs to the connector.

The thermal printhead further includes a protective cover formed of a synthetic resin. The protective cover is so provided as to cover the wiring pattern on the circuit board and the drive ICs on the head substrate. The protective cover has a lower surface which is integrally formed with a plurality of engagement pawls. By flexing the protective cover widthwise appropriately, the engagement pawls are brought into engagement with the circuit board and the head substrate, thereby mounting the protective cover onto the thermal printhead. Conversely, the protective cover may be removed from the thermal printhead by disengaging the engagement pawls from the circuit board and the head substrate.

The prior art thermal printhead has the following problems. As described above, since the protective cover mounted onto the circuit board and the head substrate is flexed, it tends to restore to its natural state, exerting a force on the circuit board and the head substrate to separate them from the heat sink plate. As a result, the circuit board and the head substrate may be partially lifted from the heat sink plate.

Further, mounting the protective cover in such a flexed state onto the thermal printhead may cause another problem. In printing, a printing paper and/or an ink ribbon is pressed against the heating resistor on the head substrate by a platen roller. At that time, the protective cover which is undesirably flexed widthwise comes into contact with the printing paper and/or the ink ribbon strongly at a particular portion or portions. As a result, the printing paper and/or the ink ribbon may be broken or wrinkled.

DISCLOSURE OF THE INVENTION

It is, therefore, an object of the present invention to provide a thermal printhead which eliminates or alleviates the problems of the prior art described above.

Another object of the present invention is to provide a protective cover which can be advantageously used in such a thermal printhead.

In accordance with a first aspect of the present invention, there is provided a protective cover for use with a thermal printhead including a heat sink plate formed with a plurality of fixing holes, a head substrate, and a circuit board, the protective cover comprising: a main body having an obverse surface and a reverse surface; and a plurality of pins extending from the reverse surface; wherein each of the pins is designed for press-fitting into a respective one of the fixing holes.

With the structure described above, the protective cover is carried on the heat sink plate. Accordingly, it is possible to prevent the head substrate and the circuit board from being separated from the heat sink plate.

The pins may be integrally formed on the main body. Alternatively, the pins may be formed separately from the main body and then bonded to the main body.

Preferably, each of the pins may be formed with at least one slit facilitating press-fitting of the pin into a respective one of the fixing holes.

In a preferred embodiment, the protective cover further includes a plurality of engagement pawls for engaging the head substrate, and each of the engagement pawls is integrally formed on the main body.

Each of the engagement pawls may extend in the same direction as the pins.

The protective cover may further include a plurality of protrusions projecting from the reverse surface of the main body, and each of the protrusions is provided adjacent to one of the engagement pawls.

In accordance with a second aspect of the present invention, there is provided a thermal printhead comprising: a heat sink plate formed with a plurality of fixing holes; a head substrate carried on the heat sink plate and provided with a heating resistor and a plurality of drive ICs; a circuit board carried on the heat sink plate and formed with a predetermined wiring pattern; and a protective cover for covering the circuit board, the protective cover having a main body including an obverse surface and a reverse surface; wherein the protective cover has a plurality of pins extending from the reverse surface of the main body, each of the pins being designed for press-fitting into a respective one of the plurality of fixing holes in the heat sink plate.

In accordance with a third aspect of the present invention, there is provided a protective cover for use with a thermal printhead including a heat sink plate, a head substrate, and a circuit board, the protective cover comprising an elongated main body including an obverse surface and a reverse surface, wherein the main body is warped so that a longitudinally central portion of the main body is located higher than other portions of the main body.

With such an arrangement, a printing paper and/or an ink ribbon comes into contact with the central portion of the protective cover relatively strongly. As a result, it is possible to prevent the printing paper and/or the ink ribbon from being broken or wrinkled.

The protective cover may further include a plurality of first engagement pieces protruding from the reverse surface of the main body for engagement with the circuit board.

The protective cover may further include a plurality of protrusions protruding from the reverse surface of the main body for engagement with the heat sink plate.

The protective cover may further include a plurality of second engagement pieces protruding from the reverse surface of the main body for engagement with the head substrate.

The protrusions may be integrally formed on the main body.

In accordance with a fourth aspect of the present invention, there is provided a thermal printhead comprising: a heat sink plate; a head substrate carried on the heat sink plate and provided with a heating resistor and a plurality of drive Ics; a circuit board carried on the heat sink plate and formed with a predetermined wiring pattern; and a protective cover for covering the circuit board, the protective cover having an elongated main body including an obverse surface and a reverse surface; wherein the main body is warped so that a longitudinally central portion of the main body is located higher than other portions of the main body.

In a preferred embodiment, the protective cover is provided with a plurality of protrusions for engagement with the heat sink plate.

Preferably, the circuit board is formed with a plurality of through-holes for allowing passage of the protrusions.

The protective cover may be provided with a plurality of first engagement pieces protruding from the reverse surface of the main body for engagement with the circuit board.

The circuit board may include cutouts for engagement with the first engagement pieces.

The protective cover may be provided with a plurality of second engagement pieces protruding from the reverse surface of the main body for engagement with the head substrate.

Other objects, features and advantages of the present invention will become clearer from the description of embodiments given below with reference to the accompanying drawings.

BEST MODE FOR CARRYING OUT THE INVENTION

The preferred embodiments of the present invention will be described below with reference to FIGS. 1 through 14.

Figure 1:
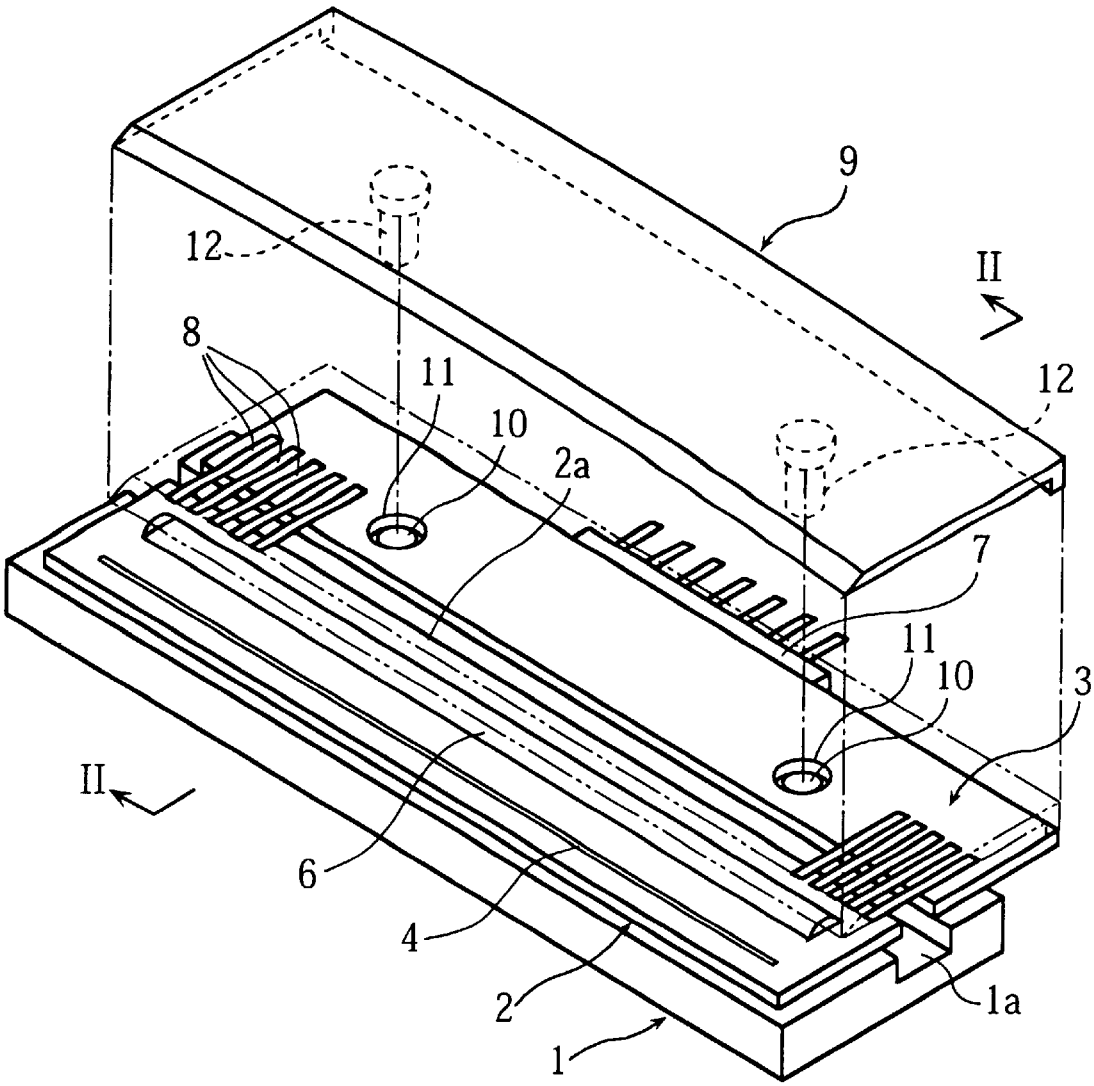
FIG. 1 is a perspective view showing a thermal printhead in accordance with a first embodiment of the present invention.

FIG. 1 schematically shows a thermal printhead in accordance with a first embodiment of the present invention. As can be seen from FIG. 1, the thermal printhead according to this embodiment includes a heat sink plate 1, a head substrate 2 and a circuit board 3. The heat sink plate 1 is made of a metal such as aluminum. The heat sink plate 1 has a rectangular upper surface which is formed with a groove 1*a* extending longitudinally of the heat sink plate 1.

Figure 2:
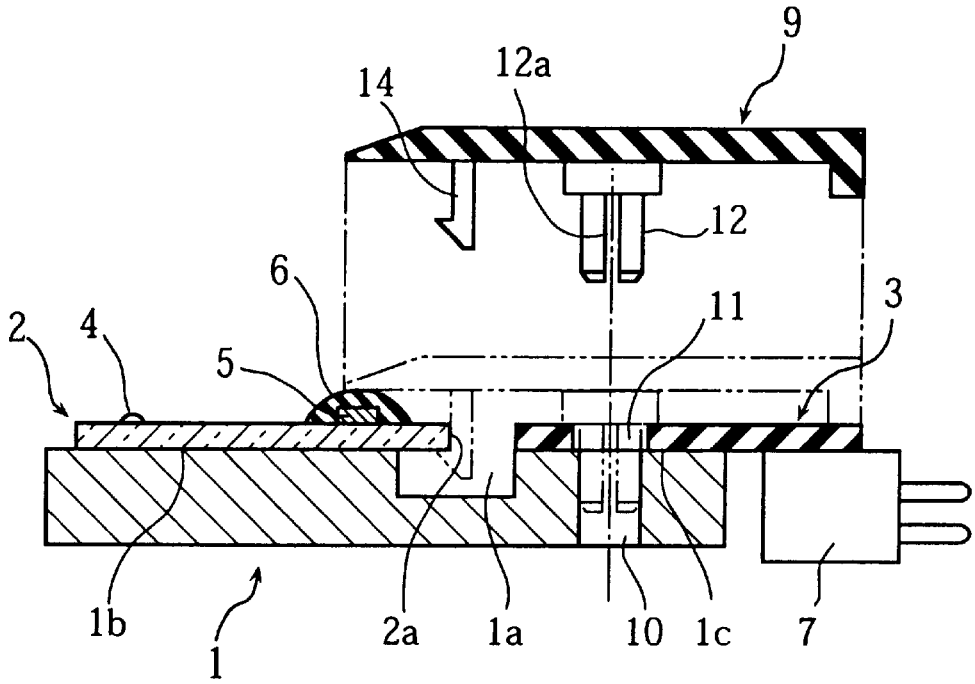
FIG. 2 is a sectional view taken along lines II—II in FIG. 1.

As shown in FIG. 2, the groove 1*a* divides the upper surface of the heat sink plate 1 into a first region 1*b* and a second region 1*c*. The head substrate 2 is made of a ceramic material and bonded to the first region 1*b* with an adhesive. The circuit board 3 is bonded to the second region 1*c* with an adhesive.

As can be seen from FIGS. 1 and 2, the head substrate 2 has an upper surface formed with a linear heating resistor 4 extending longitudinally of the head substrate. The upper surface of the head substrate 2 is further formed with a plurality of drive ICs 5 which are arranged in an array extending longitudinally of the upper surface for driving the heating resistor 4. The drive ICs 5 are covered with a coating layer 6 formed of a synthetic resin.

As shown in FIG. 1, a connector 7 is mounted to the circuit board 3 for connection to external circuitry. The upper surface of the circuit board 3 is formed with a wiring pattern (not shown) for connecting the connector 7 to the drive ICs 5.

A plurality of lead terminals 8 bridge between the head substrate 2 and the circuit board 3. The lead terminals 8 electrically connect the wiring pattern of the circuit board 3 to the drive ICs 5.

The upper surface of the circuit board 3 is covered with a protective cover 9. The protective cover 9 also covers the plurality of drive ICs 5 partially. The protective cover 9 is formed of a heat-resistant synthetic resin. The protective cover 9 has an elongated main body 9*a*. The main body 9*a* has an obverse surface, and a reverse surface facing the circuit board 3. As can be seen from FIGS. 1 and 3, the main body 9*a* is warped so that, as viewed longitudinally of the protective cover 9, a central portion of the main body 9*a* is located slightly higher than both ends.

The protective cover 9 has the following structure for removable attachment to the illustrated thermal printhead. As shown in FIGS. 1 and 2, the heat sink plate 1 is formed with two fixing holes 10. The fixing holes 10 are spaced from each other by a predetermined distance longitudinally of the heat sink plate 1. The circuit board 3 is formed with two through-holes 11 each for exposing a corresponding fixing hole 10. Each of the through-holes 11 is diametrically greater than the corresponding fixing hole 10.

As shown in FIGS. 1 and 2, the protective cover 9 is provided with two pins 12 protruding downwardly from the reverse surface thereof. The pins 12 are integral with the main body 9a of the protective cover 9. Each of the pins 12 is designed to be press-fitted in a corresponding hole 10.

With such a structure, it is possible to facilitate the mounting and removal of the protective cover 9. Further, the provision of an appropriate spacing between the two pins 12 allows precise positioning of the protective cover 9 relative to the heat sink plate 1. Moreover, the protective cover 9 need not be flexed widthwise for mounting, as opposed to the prior art. Since the protective cover 9 is directly carried on the heat sink plate 1 by means of the pins 12, the protective cover 9 does not act to separate the head substrate 2 and the circuit board 3 from the heat sink plate 1.

Figure 3:
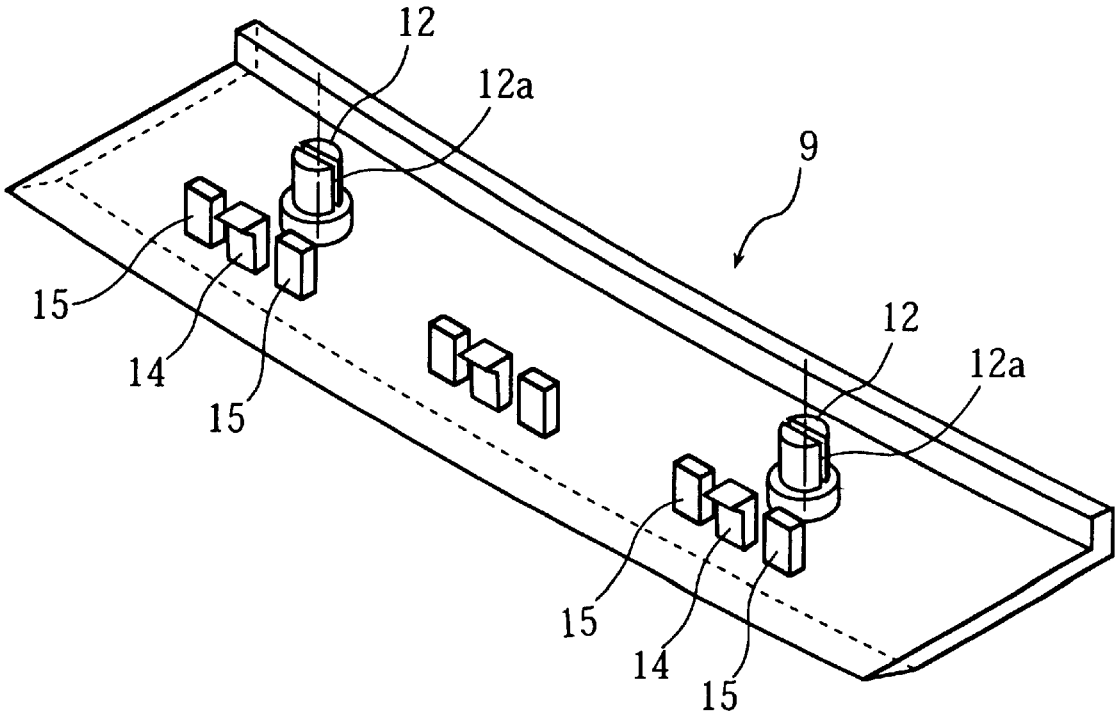
FIG. 3 is a perspective view showing the reverse surface of a protective cover.
Figure 4:
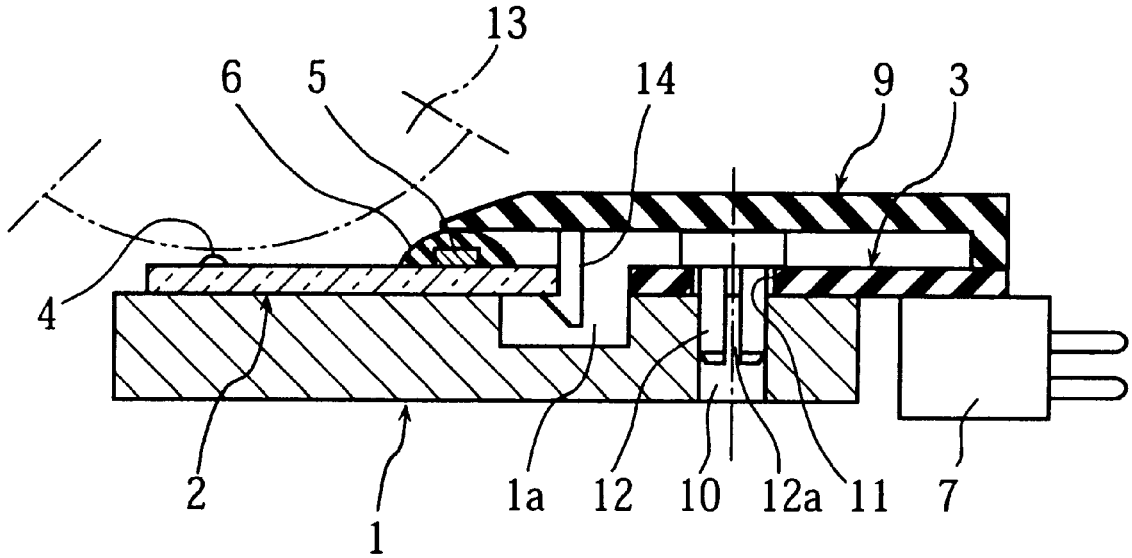
FIG. 4 is a sectional view illustrating the thermal printhead of FIG. 1 in its condition for use.

As shown in FIGS. 2 and 3, the protective cover 9 is further provided, on the reverse surface thereof, with a plurality of engagement pawls 14 which are integrally formed on the main body 9*a*. The engagement pawls 14 extend in the same direction as the pins 12. In mounting the protective cover 9 onto the heat sink plate 1, the engagement pawls 14 removably engage a longitudinal edge 2*a* of the head substrate 2. Accordingly, it is possible to positively fix the protective cover 9 to the heat sink plate 1 (See FIG. 4).

Although the illustrated engagement pawls 14 engage the head substrate 2, the engagement pawls 14 may be so arranged as to engage the circuit board 3. Alternatively, another arrangement may be employed in which some of the engagement pawls 14 engage the head substrate 2, whereas the other engagement pawl or pawls 14 engage the circuit board 3.

As shown in FIG. 3, two protrusions 15 are formed integrally formed on the main body 9*a* of the protective cover 9 at opposite sides of each engagement pawl 14. Such an arrangement prevents the engagement pawls 14 from breaking during transport of the protective cover 9 for example.

Figure 5:
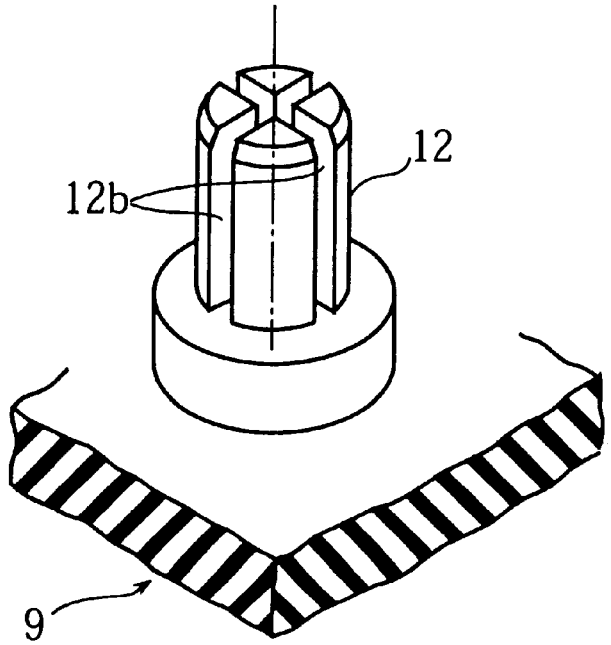
FIG. 5 illustrates an example of pin of the protective cover.

As best shown in FIG. 3, each of the pin 12 is formed with a slit 12*a* which facilitates press-fitting of the pin 12 into the corresponding fixing hole 10. Alternatively, the pin 12 may be formed with two slits 12*b* extending orthogonally to each other, as shown in FIG. 5.

Figure 6:
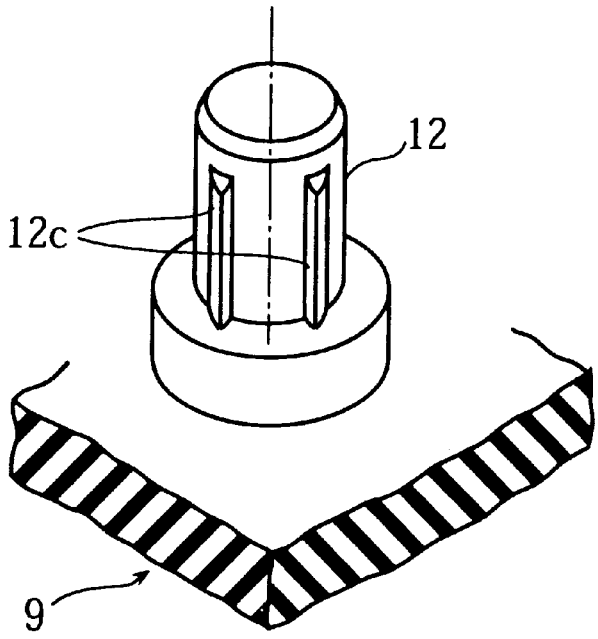
FIG. 6 illustrates another example of pin of the protective cover.
Figure 7:
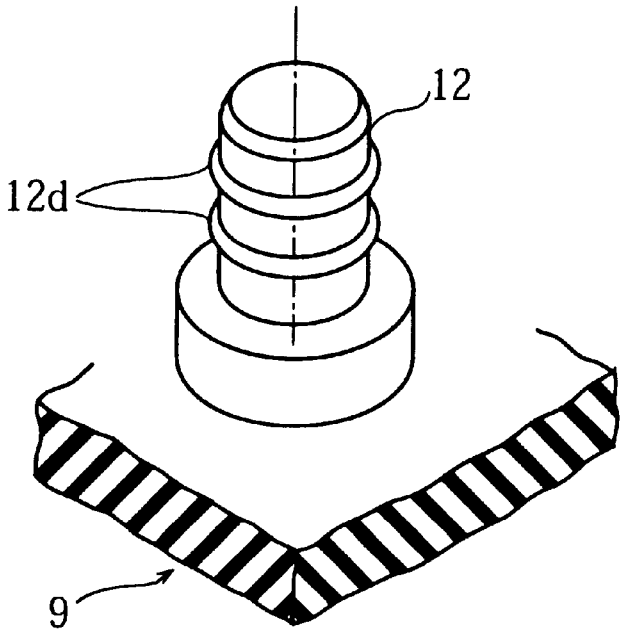
FIG. 7 illustrates still a further example of pin of the protective cover.

As shown in FIG. 6, each of the pins 12 maybe integrally formed with a plurality of axially extending ribs 12*c*. Alternatively, the pin 12 may be integrally formed with a plurality of annular ribs 12*d*, as shown in FIG. 7. In addition to these ribs, the pin may be further provided with such slits as illustrated in FIG. 5.

Figure 8:
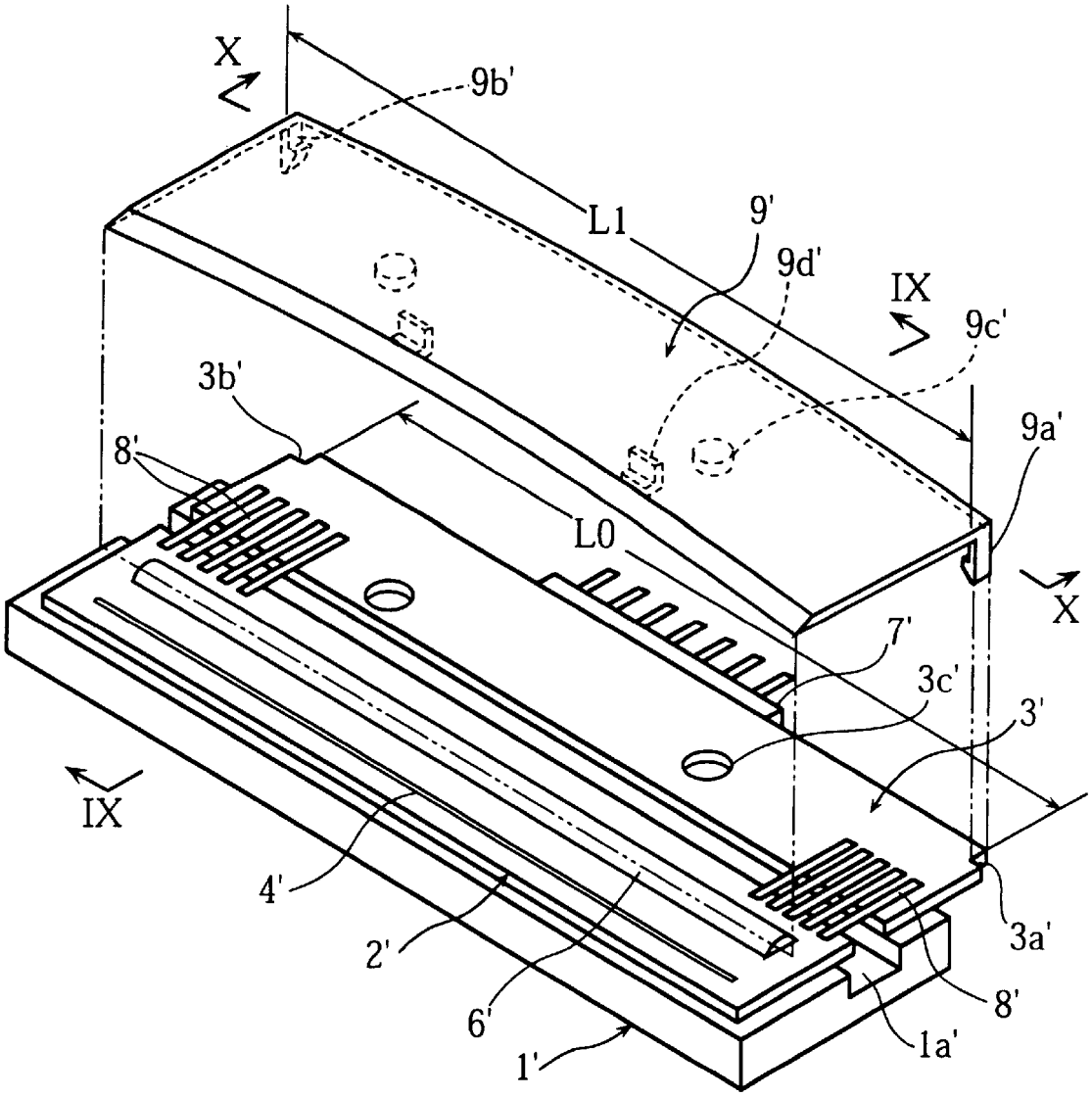
FIG. 8 is a perspective view showing a thermal printhead in accordance with a second embodiment of the present invention.
Figure 9:
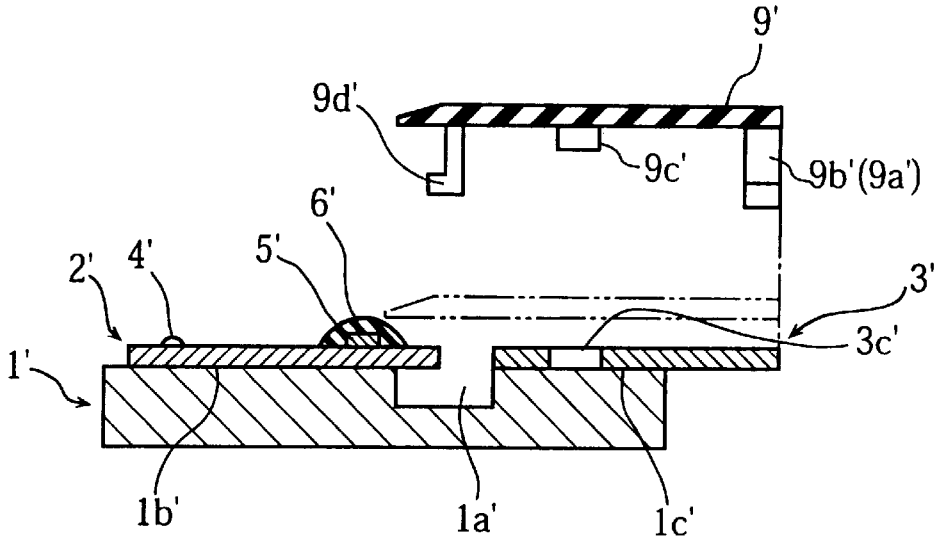
FIG. 9 is a sectional view taken along lines IX—IX in FIG. 8.

FIG. 8 schematically shows a thermal printhead in accordance with a second embodiment of the present invention. Similarly to the thermal printhead of the first embodiment, the thermal printhead of the second embodiment includes a heat sink plate 1', a head substrate 2' and a circuit board 3'. The heat sink plate 1' is made of a metal such as aluminum. The heat sink plate 1' has a rectangular upper surface which is formed with a longitudinally extending groove 1*a*'. As shown in FIG. 9, the groove 1*a*' divides the upper surface of the heat sink plate 1' into a first region 1*b*' and a second region 1*c*'. The head substrate 2' is made of a ceramic material and bonded to the first region 1*b*' with an adhesive. The circuit board 3' is bonded to the second region 1*c*' with an adhesive.

As can be seen from FIG. 8, the head substrate 2' has an upper surface formed with a linear heating resistor 4' extending longitudinally of the head substrate. The upper surface of the head substrate 2' is further formed with a plurality of drive ICs 5' arranged in an array extending longitudinally of the upper surface for driving the heating resistor 4' (See FIG. 9). The drive ICs 5' are covered with a coating layer 6' formed of a synthetic resin.

As shown in FIG. 8, a connector 7' is mounted to the circuit board 3' for connection to external circuits. The upper surface of the circuit board 3' is formed with a wiring pattern (not shown) for connecting the connector 7' to the drive ICs 5'.

A plurality of lead terminals 8' bridge between the head substrate 2' and the circuit board 3'. The lead terminals electrically connect the wiring pattern of the circuit board 3' to the drive ICs 5'.

Figure 10:
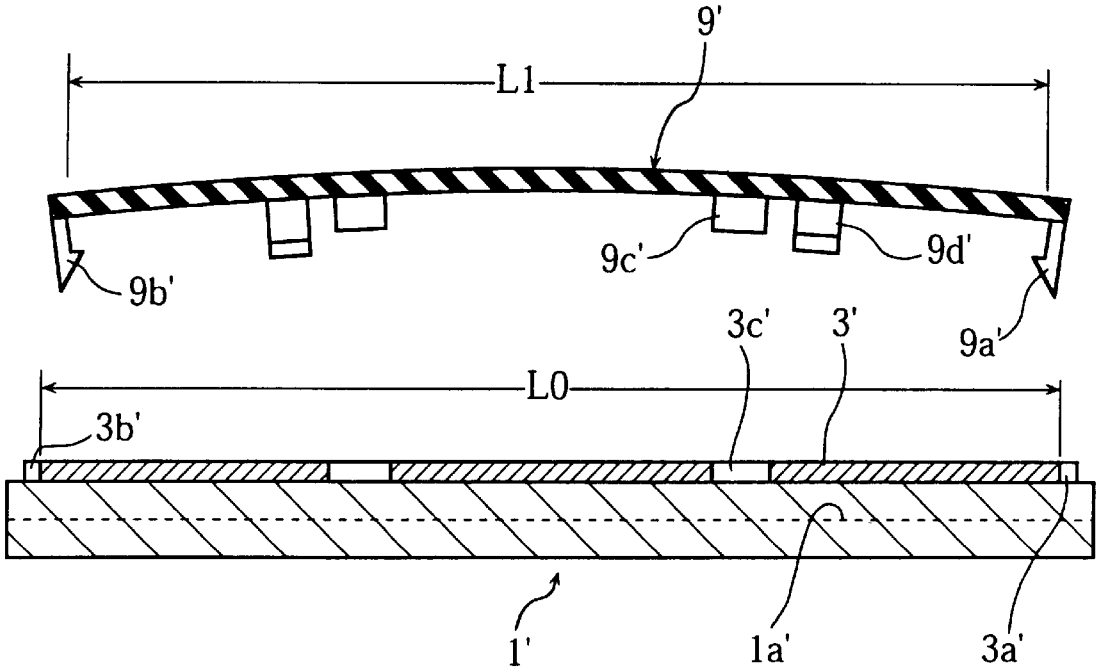
FIG. 10 is a sectional view taken along lines X—X in FIG. 8.

The upper surface of the circuit board 3' is covered with a protective cover 9'. The protective cover 9' also covers the plurality of drive ICs 5' partially. The protective cover 9' is formed of a heat-resistant synthetic resin. As shown in FIG. 10, the protective cover 9' has an elongated main body which is warped longitudinally in a natural state. Specifically, as shown in FIG. 10, the protective cover 9' is formed so that, as viewed longitudinally of the protective cover 9', a central portion of the main body is located slightly higher than both ends.

As shown in FIGS. 8 and 10, the protective cover 9' is provided, on the reverse surface thereof, with first engagement pieces 9*a*', 9*b*' which are integrally formed on the main body of the protective cover 9'. On the other hand, the circuit board 3' has cutouts 3*a*', 3*b*' provided correspondingly to the respective engagement pieces. The distance L1 between the engagement pieces 9*a*', 9*b*' is made slightly shorter than the distance L0 between the cutouts 3*a*', 3*b*'. By engaging the engagement pieces 9*a*', 9*b*' with the respective cutouts 3*a*', 3*b*', it is possible to removably mount the protective cover 9' to the circuit board 3'.

As can be seen from FIG. 8 for example, the protective cover 9' is further provided, on the reverse surface thereof, with two protrusions 9*c*' which are integrally formed on the main body of the protective cover 9'. On the other hand, the circuit board 3' is formed with two through-holes 3*c*' provided correspondingly to the respective protrusions. With such a structure, when the protective cover 9' is mounted to the circuit board 3', the protrusions 9*c*' engage the upper surface of the heat sink plate 1' (See FIG. 13).

The protective cover 9' is further provided, on the reverse surface thereof, with two second engagement pieces 9*d*' which are integrally formed on the main body of the protective cover 9' . As shown in FIG. 9, each of the second engagement pieces 9*d*' is L-shaped.

Figure 11:
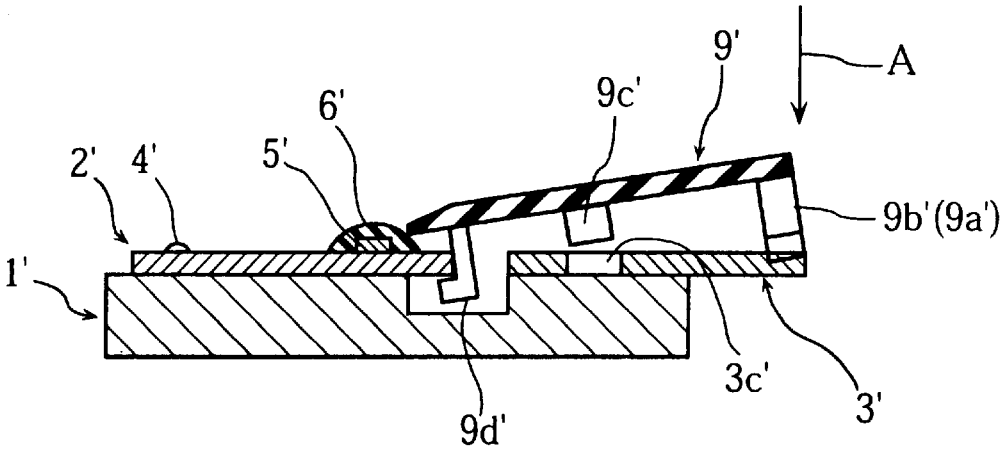
FIG. 11 illustrates the manner of mounting the protective cover.
Figure 12:
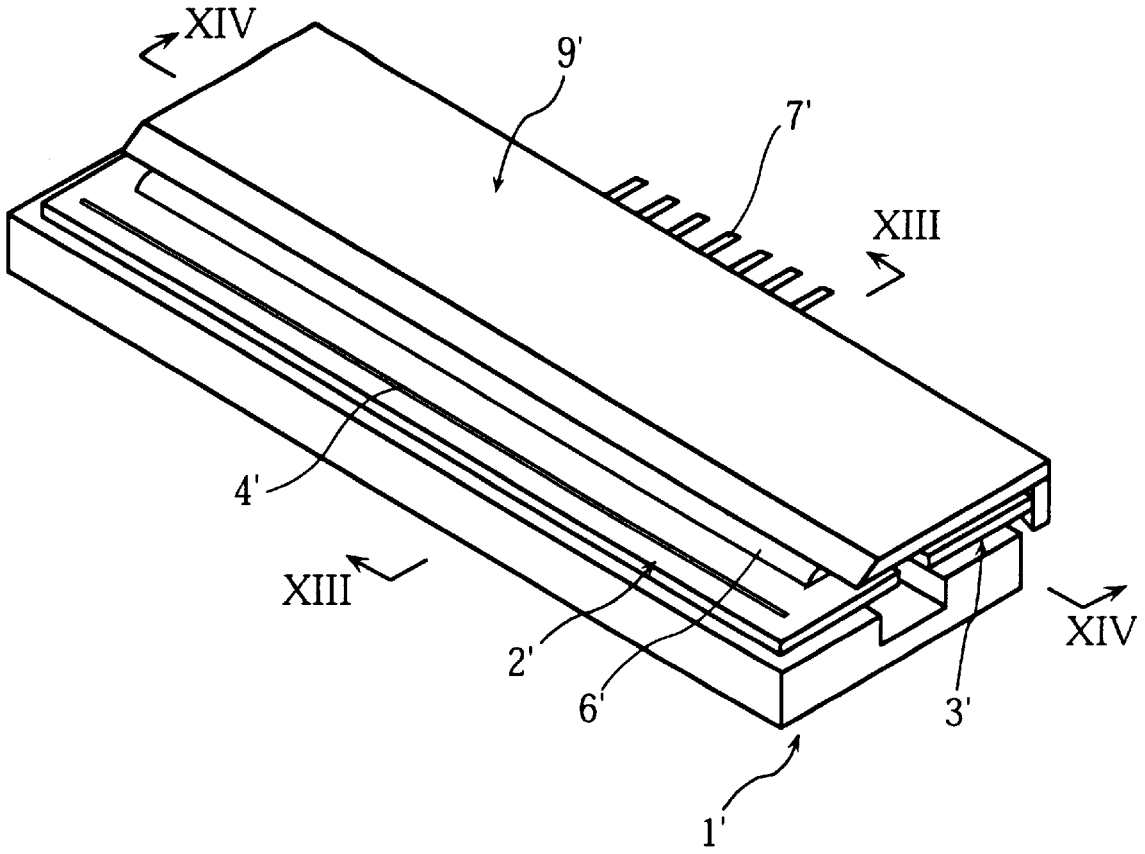
FIG. 12 is a perspective view showing the protective cover in its mounted state.
Figure 13:
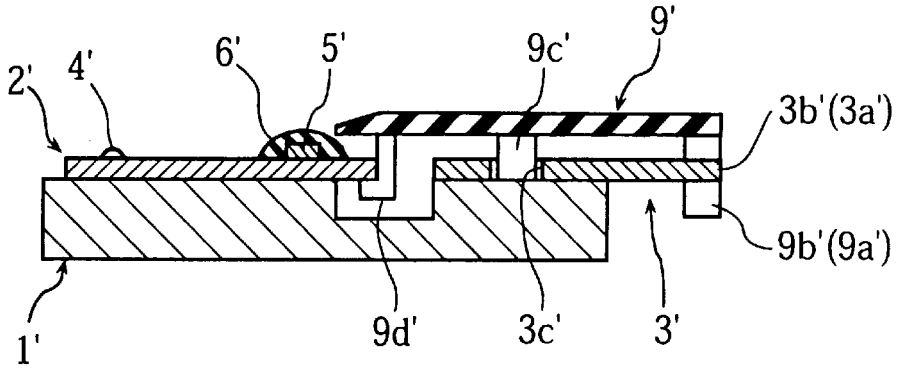
FIG. 13 is a sectional view taken along lines XIII—XIII in FIG. 12.

The protective cover 9' is mounted to the circuit board 3' in the following manner. As shown in FIG. 11, the second engagement pieces 9*d*' are brought into engagement with the head substrate 2'. Then, the protective cover 9' is pressed in the direction of an arrow A until the first engagement pieces 9*a*', 9*b*' engage the cutouts 3*a*', 3*b*', respectively. In this way, the protective cover 9' is fixed to the circuit board 3' (See FIGS. 12 and 13).

Figure 14:
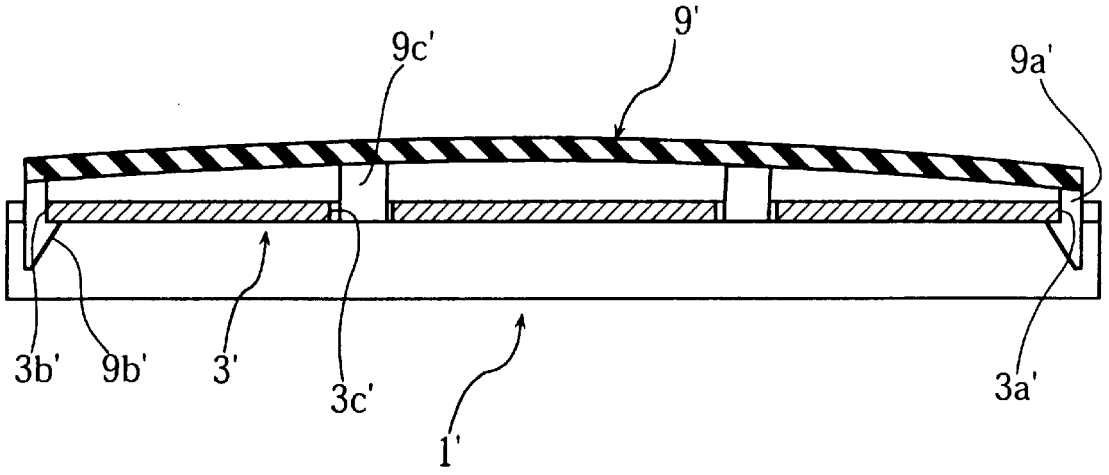
FIG. 14 is a sectional view taken along lines XIV—XIV in FIG. 12.

As described before, since the protective cover 9' is warped longitudinally in its natural state, the central portion of the protective cover 9' is held higher than the both ends even when the protective cover 9' is mounted to the circuit board 3', as shown in FIG. 14. With such an arrangement, a printing paper and/or an ink ribbon comes into contact with the central portion of the protective cover 9' relatively strongly. As a result, it is possible to prevent the printing paper and/or the ink ribbon from being broken or wrinkled.

Although the protective cover 9' described above is slightly warped (See FIG. 14), the protective cover 9' may be arranged so as to be substantially planar when mounted to the circuit board 3'. In that case, the length of protrusions 9*c*' are made shorter than those shown in FIG. 14.

According to the second embodiment, when the protective cover 9' is mounted to the circuit board 3', each of the protrusions 9*c*' is received in a corresponding through-hole 3*c*'. As a result, the protective cover 9' is prevented from being displaced from its position relative to the protective circuit 3'. Moreover, since the second engagement pieces 9*d*' are kept in engagement with the lower surface of the head substrate 2', it is possible to avoid undesirable removal of the protective cover 9' from the head substrate 2'.

What is claimed is:

1. A thermal printhead comprising:

a heat sink plate formed with a plurality of fixing holes, the heat sink plate being formed with a longitudinally extending groove for dividing the heat sink plate into a first region and a second region coplaner with the first region;

a head substrate carried on the first region of the heat sink plate and provided with a heating resistor and a plurality of drive ICs;

a circuit board carried on the second region of the heat sink plate and formed with a predetermined wiring pattern with a spacing from the head substrate, the spacing corresponding in position to the groove of the heat sink plate; and a protective cover for covering the circuit board, the protective cover having a main body including an obverse surface and a reverse surface;

wherein at least one of the head substrate and the circuit board has a longitudinal edge hanging over the groove of the heat sink plate;

wherein the protective cover is provided with engagement pieces for engaging the longitudinal edge of said at least one of the head substrate and the circuit board by utilizing the groove of the heat sink plate and the spacing between the head substrate and the circuit board;

wherein the protective cover has a plurality of pins extending from the reverse surface of the main body, each of the pins being designed for press-fitting into a respective one of the fixing holes in the heat sink plate.

2. The thermal printhead according to claim 1, wherein the pins are integrally formed on the main body.

3. The thermal printhead according to claim 1, wherein each of the pins is formed with at least one slit.

4. The thermal printhead according to claim 1, wherein each of the engagement pieces extends in the same direction as the pins.

5. The thermal printhead according to claim 1, further comprising a plurality of protrusions projecting from the reverse surface of the main body, each of the protrusions being provided adjacent to a respective one of the engagement pieces.

6. A protective cover for use with a thermal printhead including a heat sink plate, a head substrate, and a circuit board, the protective cover comprising:

an elongated main body including an obverse surface and a reverse surface;

wherein the main body is warped so that a longitudinally central portion of the main body is located higher than other portions of the main body.

7. The protective cover according to claim 6, further comprising a plurality of first engagement pieces protruding from the reverse surface of the main body for engagement with the circuit board.

8. The protective cover according to claim 7, further comprising a plurality of second engagement pieces protruding from the reverse surface of the main body for engagement with the head substrate.

9. The protective cover according to claim 6, further comprising a plurality of protrusions protruding from the reverse surface of the main body for engagement with the heat sink plate.

10. The protective cover according to claim 9, wherein the protrusions are integrally formed on the main body.

11. A thermal printhead comprising:

a heat sink plate;

a head substrate carried on the heat sink plate and provided with a heating resistor and a plurality of drive ICs;

a circuit board carried on the heat sink plate and formed with a predetermined wiring pattern; and a protective cover for covering the circuit board, the protective cover having an elongated main body including an obverse surface and a reverse surface;

wherein the main body is warped so that a longitudinally central portion of the main body is located higher than other portions of the main body.

12. The thermal printhead according to claim 11, wherein the main body of the protective cover is provided with a plurality of protrusions for engagement with the heat sink plate.

13. The thermal printhead according to claim 12, wherein the circuit board is formed with a plurality of through-holes for allowing passage of the protrusions.

14. The thermal printhead according to claim 11, wherein the protective cover is provided with a plurality of first engagement pieces protruding from the reverse surface of the main body for engagement with the circuit board.

15. The thermal printhead according to claim 14, wherein the circuit board includes cutouts for engagement with the first engagement pieces.

16. The thermal printhead according to claim 11, wherein the protective cover is provided with a plurality of second engagement pieces protruding from the reverse surface of the main body for engagement with the head substrate.

* * * * *